US008768182B2

(12) United States Patent
Mushika et al.

(10) Patent No.: US 8,768,182 B2
(45) Date of Patent: Jul. 1, 2014

(54) CARTRIDGE DETECTION

(75) Inventors: Motoaki Mushika, Hashima (JP); Masamitsu Ukai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 245 days.

(21) Appl. No.: 13/431,074

(22) Filed: Mar. 27, 2012

(65) Prior Publication Data

US 2012/0251165 A1 Oct. 4, 2012

(30) Foreign Application Priority Data

Mar. 31, 2011 (JP) ..... 2011-078637

(51) Int. Cl.
*G03G 15/00* (2006.01)

(52) U.S. Cl.
USPC ..... 399/12

(58) Field of Classification Search
CPC ..... G03G 15/0896; G03G 21/1896; G03G 21/1892; G03G 2221/1892; G03G 2221/1663
USPC ..... 399/12, 13, 25, 31, 110, 111, 119
See application file for complete search history.

(56) References Cited

U.S. PATENT DOCUMENTS

| | | | | |
|---|---|---|---|---|
| 6,154,619 | A | 11/2000 | Boockholdt et al. | |
| 7,116,919 | B2 * | 10/2006 | Ishii | 399/12 |
| 7,463,834 | B2 * | 12/2008 | Takagi et al. | 399/12 |
| 7,512,347 | B2 * | 3/2009 | Suzuki et al. | 399/12 |
| 7,536,117 | B2 * | 5/2009 | Kishi | 399/12 |
| 7,953,330 | B2 * | 5/2011 | Ishikawa | 399/12 |
| 8,090,272 | B2 * | 1/2012 | Ishikawa | 399/12 |
| 8,463,145 | B2 * | 6/2013 | Ukai et al. | 399/12 |
| 8,600,244 | B2 * | 12/2013 | Hashimoto | 399/12 |
| 2006/0193643 | A1 | 8/2006 | Takagi et al. | |
| 2006/0193646 | A1 | 8/2006 | Suzuki et al. | |
| 2012/0251216 | A1 * | 10/2012 | Mushika | 400/352 |
| 2013/0136460 | A1 * | 5/2013 | Shiraki et al. | 399/12 |

FOREIGN PATENT DOCUMENTS

| | | | |
|---|---|---|---|
| CN | 201464807 | U | 5/2010 |
| EP | 1 696 278 | A2 | 8/2006 |
| JP | 61-083570 | A | 4/1986 |
| JP | 2006-243072 | | 9/2006 |
| JP | 2006-267994 | | 10/2006 |

OTHER PUBLICATIONS

Extended European Search Report for European Patent Application No. 12157690.4 dated Jul. 16, 2012.

* cited by examiner

*Primary Examiner* — Robert Beatty
(74) *Attorney, Agent, or Firm* — Banner & Witcoff, Ltd.

(57) ABSTRACT

A cartridge which may include a housing, a driving input member provided at the housing and configured to be rotated by an externally supplied rotation driving force, and a rotational member configured to receive the rotation driving force, which is transmitted from the driving input member, and be rotated thereby. The cartridge may also include a detection protrusion including an elastic body and which is disposed at a position away from a rotational center of the rotational member. The detection protrusion may protrude from the rotational member away from the housing. The cartridge may also include a cover attached to the housing, the cover having an opposite part that faces a portion of the rotational member from which the detection protrusion protrudes. At an initial position, which is a position before the rotational member is rotated, the detection protrusion may abut the opposite part of the cover.

13 Claims, 12 Drawing Sheets

CARTRIDGE DETECTION

TECHNICAL FIELD

The present disclosure relates to a cartridge used for an image forming apparatus such as a laser printer.

BACKGROUND

In an example of a laser printer, a developing cartridge is installed in a printer body. Toner is included in the developing cartridge. The toner in the developing cartridge is used to form an image on paper. When the toner in the developing cartridge is exhausted, the developing cartridge is taken out of the printer body, and a new developing cartridge is installed in the printer body. If a paper jam occurs in the printer body, the developing cartridge is taken out of the printer body; after the paper jam has been cleared, the developing cartridge may be installed again in the printer body.

A detecting gear is attached to a side surface of the developing cartridge so as to be rotatable about an axis line (rotational axis line) extending in a direction orthogonal to the side surface. The detecting gear has a plate-like detecting gear body and an abutting protrusion formed integrally with the detecting gear body, the abutting protrusion being disposed on an outer side of the detecting gear (on a side of the detecting gear body opposite to the side surface of the developing cartridge). Gear teeth are formed on the circumferential surface of the detecting gear except some portion of the circumferential surface.

With a new developing cartridge, the gear teeth of the detecting gear are engaged with the gear teeth of a transmission gear. When the developing cartridge is installed in the printer body, the driving force of a motor is supplied to the transmission gear, and the driving force is transmitted from the transmission gear to the detection gear through their gear teeth.

Thus, the detection gear rotates, and the abutting protrusion of the detecting gear moves in the rotational direction of the detecting gear due to the rotation of the detecting gear. When the detecting gear further rotates and a missing tooth portion of the detecting gear faces the gear teeth of the transmission gear, the engagement between the gear teeth of the transmission gear and the gear teeth of the detecting gear is released, stopping the rotation of the detecting gear. Accordingly, after the developing cartridge has been installed in the printer body even once and the driving force is supplied to the transmission gear, the engagement between the gear teeth of the transmission gear teeth of the gear teeth of the detecting gear is released and the disengaged state is kept after that.

In the printer body, a sensor that detects the passage of the abutting protrusion is provided, regarding the abutting protrusion as a protrusion to be detected. Whether the developing cartridge is a new one or an old one is determined depending on whether the sensor has detected the passage of the abutting protrusion. Specifically, after the developing cartridge has been installed in the printer body, if the passage of the abutting protrusion is detected by the sensor, the developing cartridge is determined to be new. However, after the developing cartridge has been installed in the printer body, if the passage of the abutting protrusion is not detected by the sensor, the developing cartridge is determined to be old.

If, however, an amount by which the abutting protrusion protrudes from the side surface of the developing cartridge is large, when the developing cartridge is installed in or removed from the printer body, the abutting protrusion may rub against a member in the printer body and may wear out.

Further, with the large amount of protrusion of the abutting protrusion is that when the developing cartridge is installed in or removed from the printer body, the abutting protrusion may come into contact with a member in the printer body or may be caught by the member and the abutting protrusion and/or the member in the printer body may thereby be damaged.

SUMMARY

Aspects of the disclosure provide a cartridge that can reduce the wear of a detection protrusion. For example, in an illustrative embodiment of the disclosure, a cartridge which may include a housing, a driving input member provided at the housing and configured to be rotated by an externally supplied rotation driving force, and a rotational member configured to receive the rotation driving force, which is transmitted from the driving input member, and be rotated thereby. The cartridge may also include a detection protrusion including an elastic body and which is disposed at a position away from a rotational center of the rotational member. The detection protrusion may protrude from the rotational member away from the housing. The cartridge may also include a cover attached to the housing, the cover having an opposite part that faces a portion of the rotational member from which the detection protrusion protrudes. At an initial position, which is a position before the rotational member is rotated, the detection protrusion may abut the opposite part of the cover, wherein the opposite part of the cover is configured to elastically deform the detection protrusion when the detection protrusion is positioned in a state in which the detection protrusion abuts the inside of the cover.

When, for example, the cartridge is installed in or removed from the printer body, therefore, contact of the detection protrusion with other members can be reduced and the wear and damage of the detection protrusion due to the contact can be reduced.

According to aspects of the disclosure, a cartridge may include a housing, a driving input member provided in the housing and configured to be rotated by an externally supplied rotation driving force, and a rotational member configured to receive the rotation driving force, which is transmitted from the driving input member, and be rotated thereby. The rotational member may include a detection protrusion including an elastic body and which is disposed at a position away from a rotational center of the rotational member. The cartridge may also include a cover attached to the housing, the cover having an opposite part that faces the rotational member. At an initial position, which is a position before the rotational member is rotated, and at a terminal position, which is a position after the rotational member has completed rotating, the detection protrusion may abut an inside of the cover and be elastically deformed by the inside of the cover. At a point between the initial position and the terminal position, the detection protrusion may be released from an inside of the cover and positioned in a state in which the detection protrusion is not elastically deformed.

DETAILED DESCRIPTION

An embodiment of the present disclosure will be described below in detail with reference to the attached drawings.

1. Entire Structure of a Laser Printer

Figure 1:
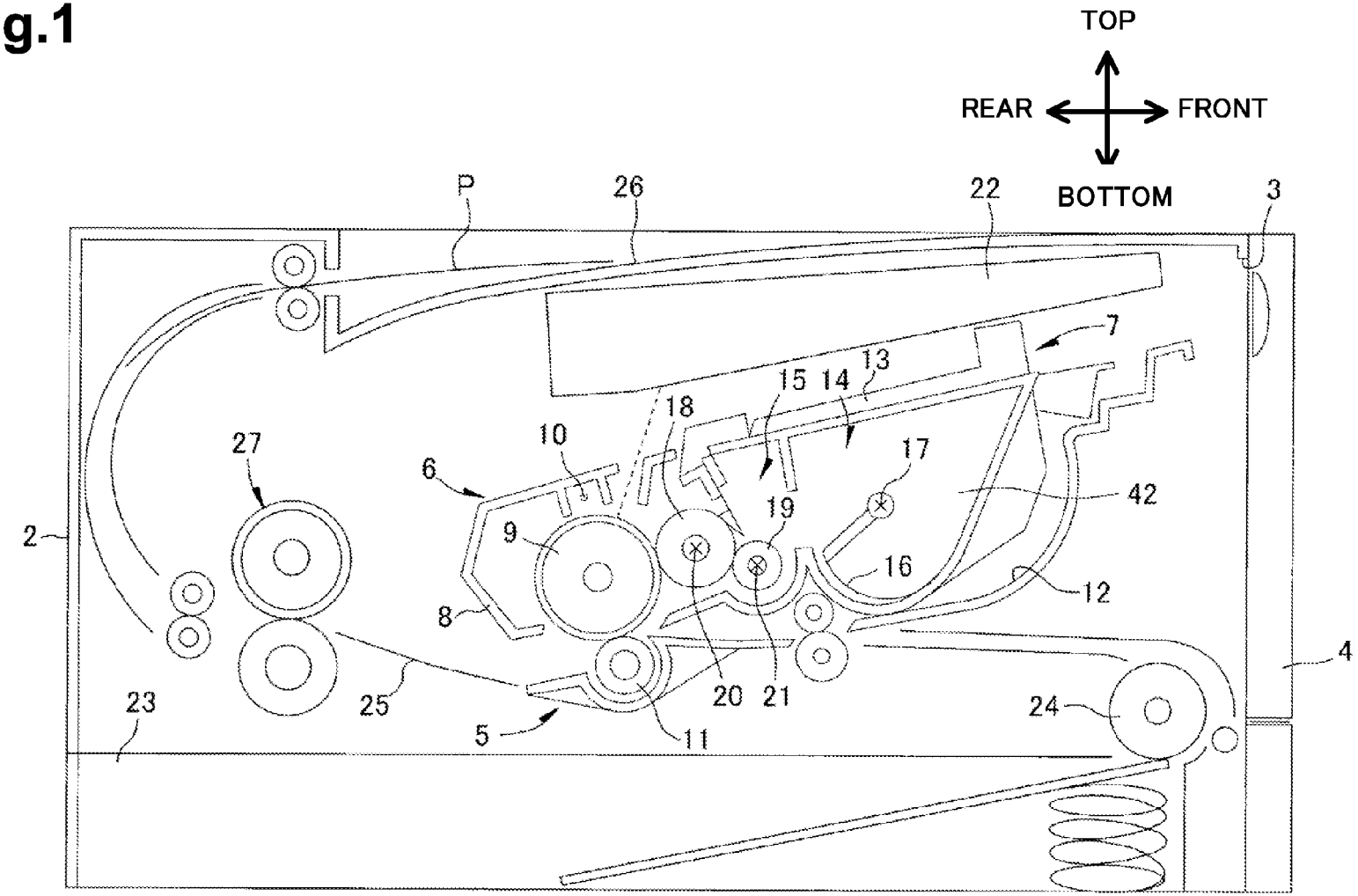
FIG. 1 is a cross-sectional view of a laser printer in which a developing cartridge according to an embodiment of the present disclosure is installed.

As illustrated in FIG. 1, a laser printer 1 has a main body casing (printer body) 2. A side wall at the front of the main body casing 2 has a cartridge installing/removing port 3 and a front cover 4 that opens and closes the installing/removing port 3.

The front of the laser printer 1 is on the forward side in the fore-aft direction. The upper sides, lower sides, right sides, and left sides of the laser printer 1 placed on a flat surface and a developing cartridge 7 (described later) installed in the main body casing 2 of the laser printer 1 are defined as viewed from the front.

A process cartridge 5 is installed at a position a little apart from the center in the main body casing 2 toward the front. The process cartridge 5 is inserted into the main body casing 2 through the installing/removing port 3 with the front cover 4 open, and is removed from the main body casing 2.

The process cartridge 5 has a drum cartridge 6 and the developing cartridge 7, which is an example of a cartridge that is removably installed in the drum cartridge 6.

The drum cartridge 6 has a drum frame 8. A photosensitive drum 9 is rotatably held at the rear end of the drum frame 8. A charger 10 and a transfer roller 11 are held in the drum frame 8. The charger 10 is disposed above the photosensitive drum 9 and the transfer roller 11 is disposed below the photosensitive drum 9.

In the drum frame 8, a portion in front of the photosensitive drum 9 is a cartridge installation part 12. The developing cartridge 7 is installed in the cartridge installation part 12.

The developing cartridge 7 has a housing 13 in which toner is included. A toner room 14 and a developing room 15, which mutually communicate, are adjacently formed fore and aft in the housing 13.

An agitator 16 is provided in the toner room 14 so as to be rotatable about an agitator rotational axis line 17 extending in the right and left direction. The toner in the toner room 14 is stirred by the rotation of the agitator 16 and is fed from the toner room 14 to the developing room 15.

In the developing room 15, a developing roller 18 is provided so as to be rotatable about a developing rotational axis line 20 extending in the right and left direction and a supply roller 19 is also provided so as to be rotatable about a supply rotational axis line 21 extending in the right and left direction.

The developing roller 18 is disposed so that part of its circumferential surface is exposed from the rear end of the housing 13. The developing cartridge 7 is installed in the drum cartridge 6 so that the circumferential surface of the developing roller 18 comes into contact with the circumferential surface of the photosensitive drum 9.

The supply roller 19 is disposed so that its circumferential surface comes into contact with the circumferential surface of the developing roller 18 from its lower side on the front side. The toner in the developing room 15 is supplied by the supply roller 19 to the circumferential surface of the developing roller 18 and is supported on the circumferential surface of the developing roller 18 as a thin layer.

In the main body casing 2, an exposure unit 22 including a laser and the like is disposed above the process cartridge 5.

During the formation of an image, the photosensitive drum 9 is rotated at a fixed speed clockwise as viewed from the left side. The circumferential surface (front surface) of the photosensitive drum 9 is uniformly charged due to the discharging of the charger 10 when the photosensitive drum 9 rotates. The exposure unit 22 is controlled according to image data, and a laser beam is emitted from the exposure unit 22. For example, the laser printer 1 is connected to a personal computer (not shown), and the image data is sent from the personal computer to the laser printer 1. The laser beam passes between the charger 10 and the developing cartridge 7 and is incident on the uniformly charged circumferential surface of the photosensitive drum 9, selectively exposing the circumferential surface of the photosensitive drum 9. This exposure selectively removes charges from exposed parts of the photosensitive drum 9, forming an electrostatic latent image on the circumferential surface of the photosensitive drum 9. When the photosensitive drum 9 rotates and the electrostatic latent image faces the developing roller 18, toner is supplied from the developing roller 18 to the electrostatic latent image and the electrostatic latent image is developed as a toner image.

A paper supply cassette 23 that stores paper P is provided at the bottom of the main body casing 2. A pickup roller 24 used to feed out paper from the paper supply cassette 23 is provided above the paper supply cassette 23.

A transport path 25, which is S-shaped as viewed from a side, is formed in the main body casing 2. The transport path 25 extends from the paper supply cassette 23 through the photosensitive drum 9 and transfer roller 11 to a paper ejection tray 26 formed on the upper surface of the main body casing 2.

The toner image on the circumferential surface of the photosensitive drum 9 is transferred to the paper P that passes between the photosensitive drum 9 and the transfer roller 11 by the effect of a bias applied to the transfer roller 11.

On the transport path 25, a fixing unit 27 is provided downstream of the transfer roller 11 in the direction in which the paper P is transported. The paper P on which the toner image has been transferred is transported along the transport path 25 and passes through the fixing unit 27. In the fixing unit 27, the toner image is heated and pressurized to fix it to the paper P as an image. The paper P, on which the image has been formed in this way, is further transported along the transport path 25 and is ejected onto the paper ejection tray 26.

2. Developing Cartridge 2-1. Housing

Figure 2:
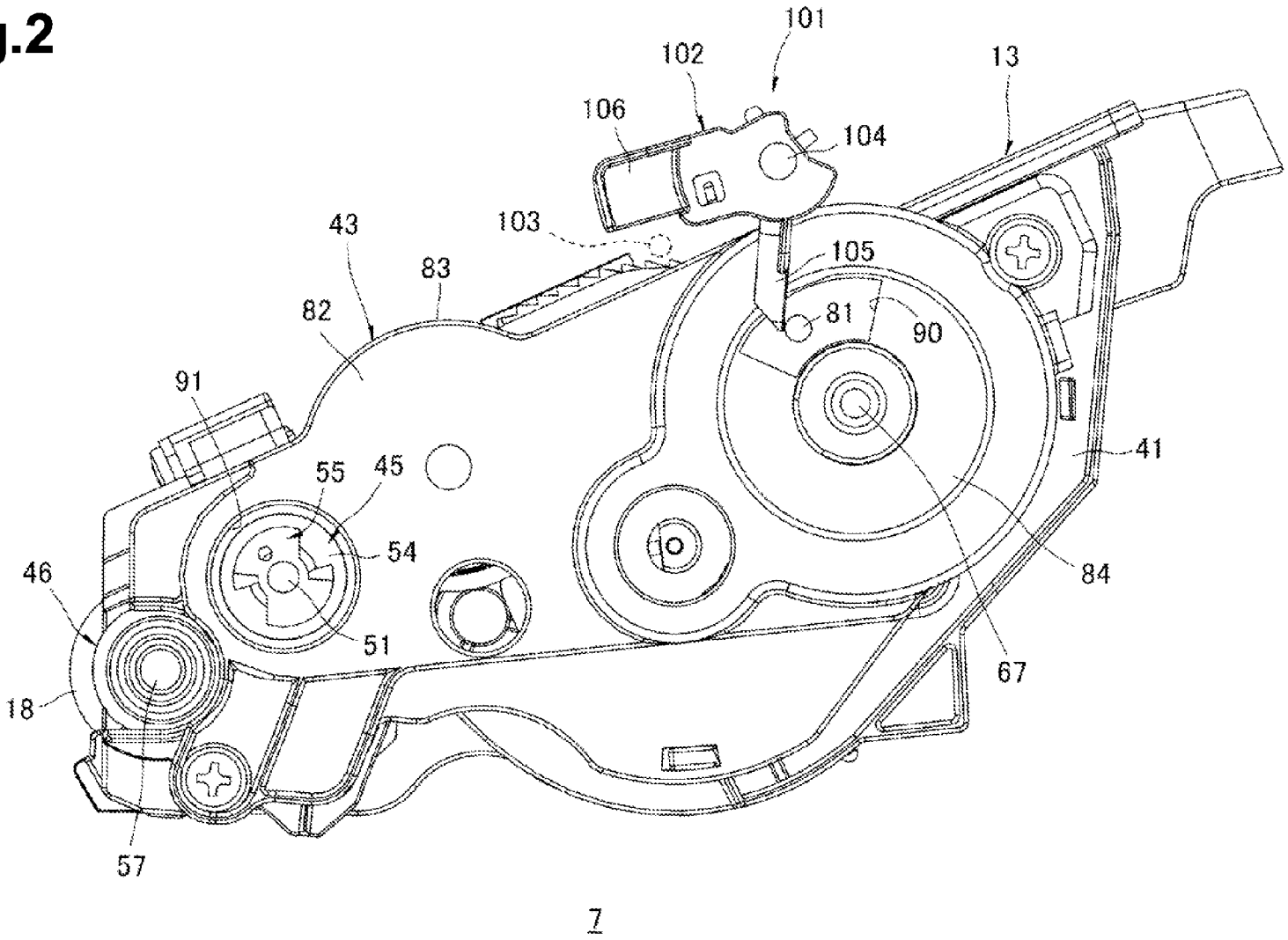
FIG. 2 is a left side view of the developing cartridge.

The housing 13 of the developing cartridge 7 has a first side wall 41 (see FIG. 2) and a second side wall 42 (see FIG. 1) that face each other with a spacing therebetween in the right and left direction, as shown in FIGS. 1 and 2.

2-2. Gear Train

Figure 3:
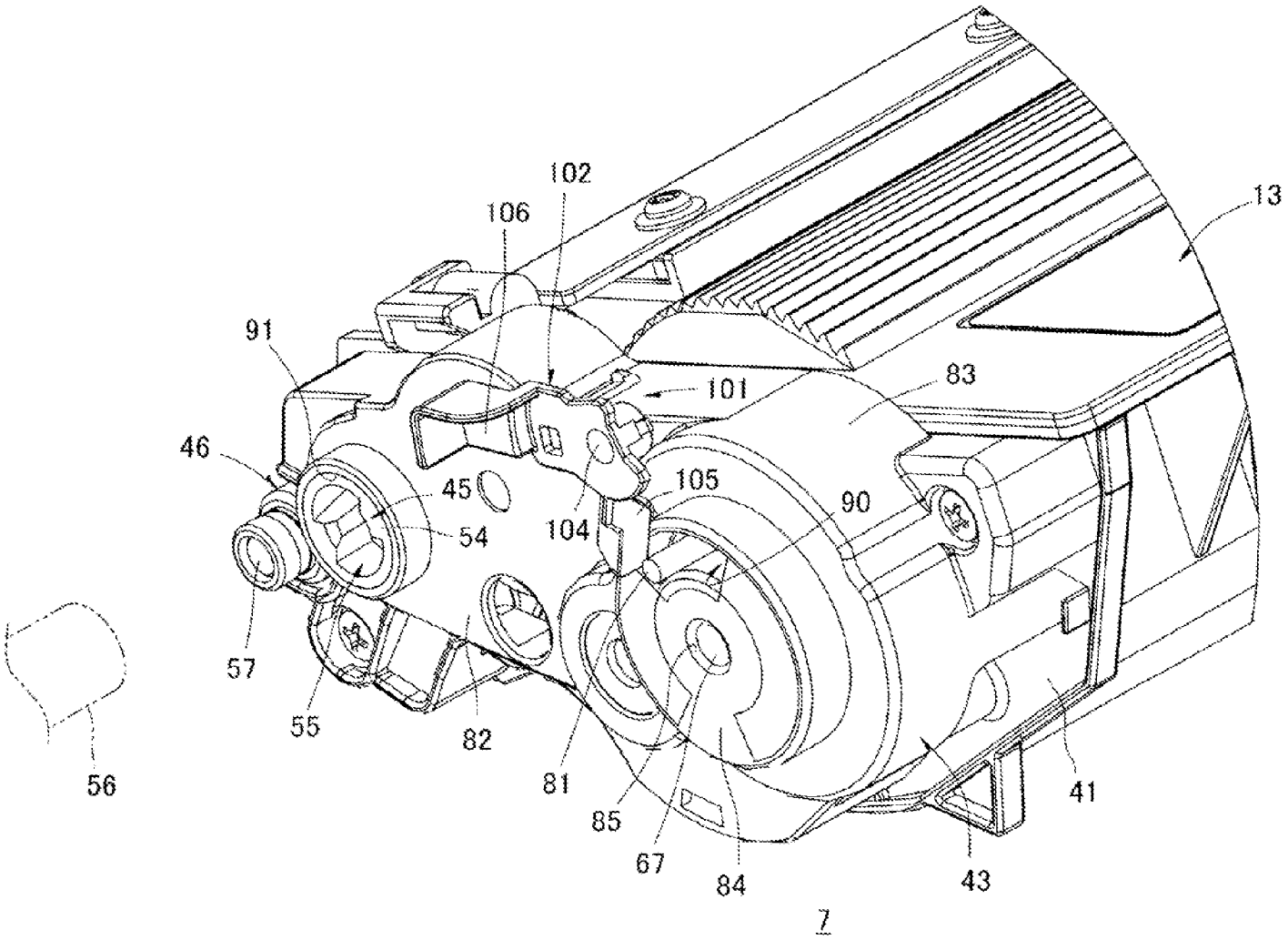
FIG. 3 is a perspective view, as viewed from the front on the left side.
Figure 4:
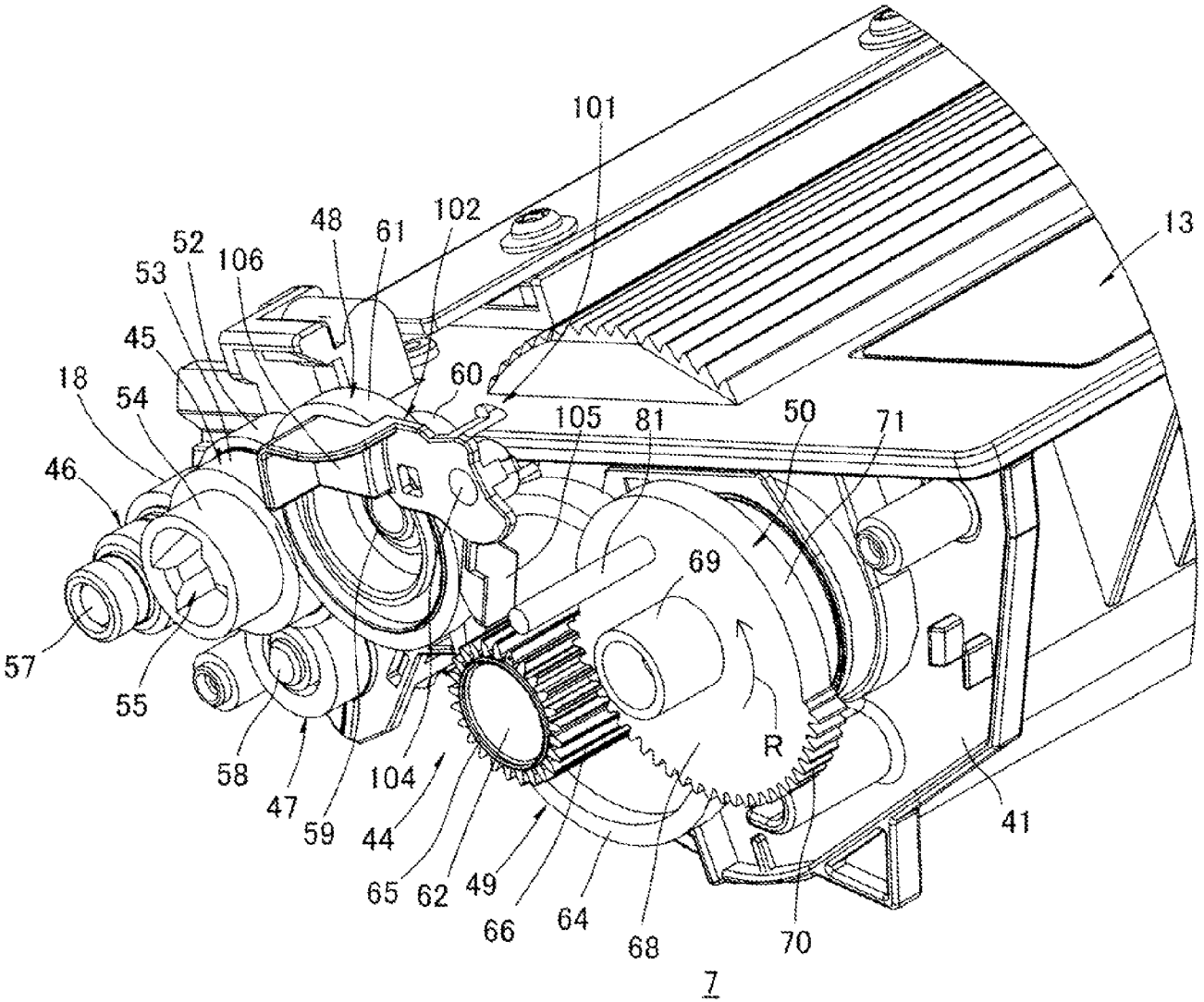
FIG. 4 is a perspective view, as viewed from the front on the left side, indicating a state in which a gear cover is removed.

A gear cover 43 is attached to the external side surface (left surface) of the first side wall 41 used as an example of a cover, as shown in FIGS. 2 and 3. A gear train 44 is provided inside the gear cover 43, as shown in FIG. 4. The gear train 44 includes an input gear 45 used as an example of a driving input member, a developing gear 46, a supply gear 47, an intermediate gear 48, an agitator gear 49 used as an example of a transmitting member, and a reset gear 50 used as an example of a rotating member.

2-2-1. Input Gear

The input gear 45 is placed at an upper portion at the rear end of the first side wall 41. The input gear 45 is disposed so as to be rotatable about an input gear rotational axis 51 (see FIG. 2) that extends in the right and left direction. The input gear rotational axis 51 is held to the first side wall 41 so as not to be rotatable.

The input gear 45 integrally has a large-diameter gear part 52, a small-diameter gear part 53, and a coupling part 54 as shown in FIG. 4. The large-diameter gear part 52, small-diameter gear part 53, and coupling part 54 are placed in that order from the same side as the first side wall 41.

The large-diameter gear part 52 is formed in a discoid shape, which has a central axis line that matches the central axis line of the input gear rotational axis 51. Many gear teeth are formed over the entire circumferential surface of the large-diameter gear part 52.

The small-diameter gear part 53 is formed in a discoid shape, which has a central axis line that matches the central axis line of the input gear rotational axis 51, the small-diameter gear part 53 having a smaller diameter than the large-diameter gear part 52. Many gear teeth are formed over the entire circumferential surface of the small-diameter gear part 53.

The coupling part 54 is formed in a columnar shape, which has a central axis line that matches the central axis line of the input gear rotational axis 51, the circumferential surface of the coupling part 54 having a smaller diameter than the circumferential surface of the small-diameter gear part 53. A linkage recess 55 is formed in the left side surface of the coupling part 54. With the developing cartridge 7 installed in the main body casing 2, the distal end of a driving output member 56 (see FIG. 3) provided in the main body casing 2 is inserted into the linkage recess 55.

The driving output member 56 is provided so as to be advanceable and retractable in the right and left direction. With the developing cartridge 7 installed in the main body casing 2, the driving output member 56 advances to the right and its distal end is inserted into the linkage recess 55. Thus, the driving output member 56 and linkage recess 55 are mutually joined so as not to be relatively rotatable. When the driving output member 56 is rotated, therefore, the rotational force of the driving output member 56 is received by the input gear 45 as a driving force and the input gear 45 is thereby rotated together with the driving output member 56.

2-2-2. Developing Gear

The developing gear 46 may be placed below and behind the input gear 45 as shown in FIG. 4. The developing gear 46 is attached to a developing roller axis 57 of the developing roller 18 so as not to be relatively rotatable. The developing roller axis 57 is rotatably attached to the first side wall 41; the central axis line of the developing roller axis 57 is the developing rotational axis line 20 (see FIG. 1), which is the rotational axis line of the developing roller 18. Gear teeth are formed over the entire circumferential surface of the developing gear 46; the gear teeth have been engaged with the gear teeth of the large-diameter gear part 52 of the input gear 45.

2-2-3. Supply Gear

The supply gear 47 may be placed below the input gear 45 as shown in FIG. 4. The supply gear 47 is attached to a supply roller axis 58 of the supply roller 19 (see FIG. 1) so as not to be relatively rotatable. The supply roller axis 58 is rotatably attached to the first side wall 41; the central axis line of the supply roller axis 58 is the supply rotational axis line 21 (see FIG. 1), which is the rotational axis line of the supply roller 19. Gear teeth are formed over the entire circumferential surface of the supply gear 47; the gear teeth of the supply gear 47 be engaged with the gear teeth of the large-diameter gear part 52 of the input gear 45.

2-2-4. Intermediate Gear

The intermediate gear 48 may be placed above and in front of the input gear 45 as shown in FIG. 4. The intermediate gear 48 is disposed so as to be rotatable about the central axis line of an intermediate gear rotational axis 59 extending in the right and left direction. The intermediate gear rotational axis 59 is held to the first side wall 41 so as not to be rotatable.

The intermediate gear 48 integrally has a small-diameter part 60, which is formed in a discoid shape with a relatively small outer diameter, and a large-diameter part 61, which is formed in a columnar shape with a relatively large outer diameter, as shown in FIG. 3. The small-diameter part 60 and large-diameter part 61 are placed in that order from the same side as the first side wall 41. The central axis lines of the small-diameter part 60 and large-diameter part 61 match the central axis line of the intermediate gear rotational axis 59.

Gear teeth are formed over the entire circumferential surface of the small-diameter part 60. Gear teeth are formed over the entire circumferential surface of the large-diameter part 61; the gear teeth of the large-diameter part 61 have been engaged with the gear teeth of the small-diameter gear part 53 of the input gear 45.

2-2-5. Agitator Gear

The agitator gear 49 may be placed below and in front of the intermediate gear 48 as shown in FIG. 4. The agitator gear 49 is attached to an agitator rotational axis 62 so as not to be relatively rotatable. The agitator rotational axis 62 passes through the first side wall 41 and second side wall 42 (see FIG. 1) in the right and left direction and is rotatably held to the first side wall 41 and second side wall 42. In the housing 13, the agitator 16 is attached to the agitator rotational axis 62. Accordingly, the agitator 16 and agitator gear 49 use the central axis line of the agitator rotational axis 62 as the agitator rotational axis line 17 (see FIG. 1), so they are rotatable together with the agitator rotational axis 62.

The agitator gear 49 integrally has a large-diameter gear part 64 and a small-diameter gear part 65. The large-diameter gear part 64 is formed in a discoid shape, which has a central axis line that matches the central axis line of the agitator rotational axis 62. Gear teeth are formed over the entire circumferential surface of the large-diameter gear part 64. The gear teeth of the large-diameter gear part 64 have been engaged with the gear teeth of the small-diameter part 60 of the intermediate gear 48.

The small-diameter gear part 65 is formed on a side opposite to the first side wall 41 with respect to the large-diameter gear part 64, has a discoid shape, which has a central axis line that matches the central axis line of the agitator rotational axis 62, and has a smaller diameter than the large-diameter gear part 64. Gear teeth 66 are formed over the entire circumferential surface of the small-diameter gear part 65.

2-2-6. Reset Gear

The reset gear 50 may be placed above and in front of the agitator gear 49 as shown in FIG. 4. The reset gear 50 is disposed so as to be rotatable about a rotational axis 67 (see FIG. 2) extending in the right and left direction. The rotational axis 67 is held to the first side wall 41 so as not to be rotatable.

The reset gear 50 integrally has a missing tooth gear part 68 used as an example of a passive part and a cylindrical boss 69, which is cylindrical.

The missing tooth gear part 68 is formed in a discoid shape, which has a central axis line that matches the central axis line of the rotational axis 67. Gear teeth 70 are formed on part of the circumferential surface of the missing tooth gear part 68. Specifically, a portion having a central angle of about 185 degrees is formed on the circumferential surface of the missing tooth gear part 68 as a missing tooth part 71, and gear teeth 70 are formed on a portion having a central angle of about 175 degrees outside the missing tooth part 71. The gear teeth 70 are engaged with the gear teeth 66 of the small-diameter gear part 65 of the agitator gear 49 at some rotational position of the reset gear 50.

The cylindrical boss 69, which protrudes from the left end surface of the missing tooth gear part 68 to the left, is formed in a cylindrical shape, which has a central axis line that matches the central axis line of the missing tooth gear part 68. The rotational axis 67 is inserted into the cylindrical boss 69 so as to be relatively rotatable. Accordingly, the reset gear 50 is rotatably supported with the rotational axis 67 acting as a fulcrum.

2-3. Detection Protrusion

On the left end surface of the missing tooth gear part 68 of the reset gear 50, a detection protrusion 81 is provided. The detection protrusion 81 is formed in an elongated round rod shape, which protrudes, to the left, from a portion having the missing tooth part 71 of the missing tooth gear part 68 as a circumferential surface. The detection protrusion 81 is formed of an elastic body such as rubber or urethane foam.

2-4. Gear Cover

A gear cover 43 integrally has an opposite wall 82, which faces the first side wall 41 from the left side, and a circumferential wall 83, which extends toward the first side wall 41 from the circumferential edge of the opposite wall 82, as shown in FIG. 3. The gear cover 43 is made of, for example, a resin.

Figure 5:
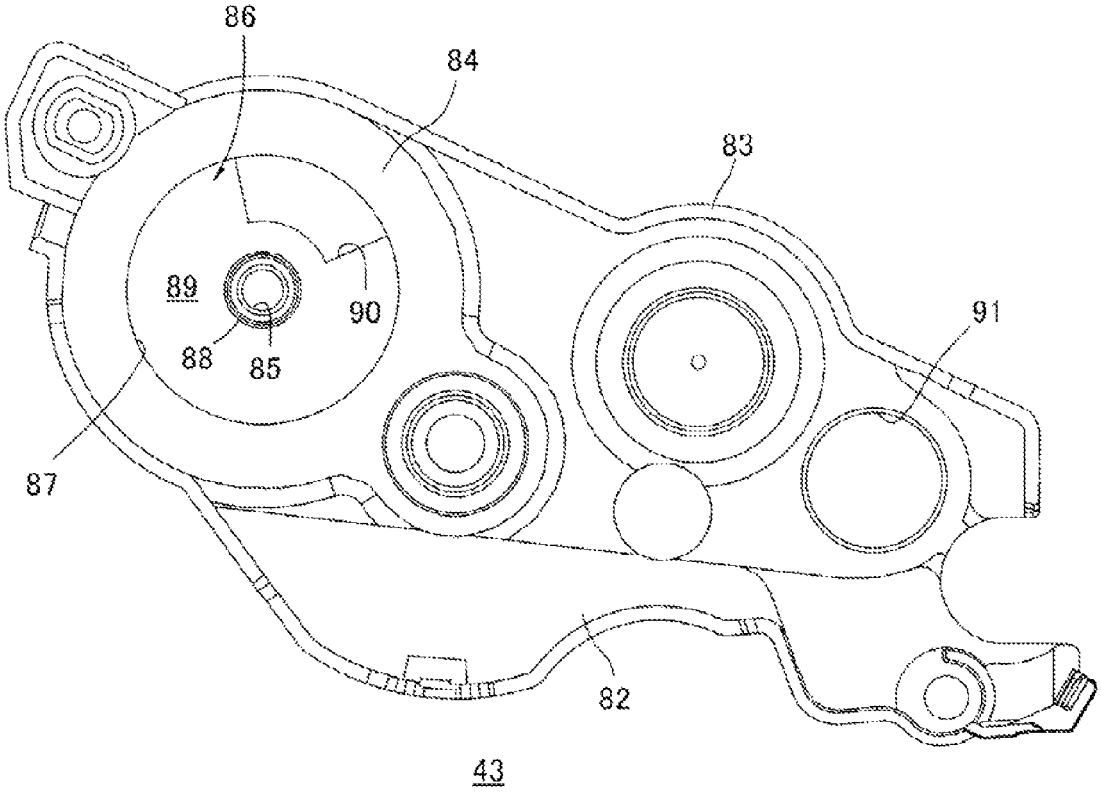
FIG. 5 is a side view indicating the inside of the gear cover.

The opposite wall 82 has an opposite part 84, which faces the reset gear 50 from the left side as shown in FIGS. 3 and 5. The opposite part 84 has a circular shape as viewed from a side. A round hole 85, which is a through-hole, is formed at the center of the opposite part 84. The distal end of the rotational axis 67 is placed in the round hole 85 as shown in FIG. 3.

On the inner surface of the opposite part 84, a recess 86, which has a circular shape concentric with the round hole 85 and is one step deeper, is formed on a side opposite to the first side wall 41 (on the left side). Accordingly, a cylindrical side wall 87, which is linked to the inside and outside of the recess 86, is formed on the inner surface of the opposite part 84. On the inner surface of the opposite part 84, a cylindrical guide wall 88 is also formed, which protrudes from the circumferential edge of the round hole 85 toward the first side wall 41 (to the right). The side wall 87 and the outer circumferential surface of the guide wall 88 face each other with a fixed spacing therebetween; a portion in a circular ring shape having the fixed interval between the side wall 87 and the outer circumferential surface of the guide wall 88 forms a guide part 89 that guides the movement of the detection protrusion 81.

The opposite part 84 has an opening 90, which is formed by cutting part of the fixed interval between the side wall 87 and the outer circumferential surface of the guide wall 88, specifically which is an uppermost portion of the fixed interval and is a little near the backward end. The opening 90 has a width in a radial direction of the opposite part 84, which is adequately larger than the diameter of the detection protrusion 81. The opening 90 also has a length in the circumferential direction of the opposite part 84; a straight line including an end edge in the circumferential direction and a straight line including the other end edge form an acute angle of about 80 degrees. The opposite wall 82 has an opening 91 through which the coupling part 54 of the input gear 45 is exposed.

3. Detection Mechanism

A detection mechanism 101 that detects the detection protrusion 81 is provided in the main body casing 2 as shown in FIGS. 2 and 3. The detection mechanism 101 includes an actuator 102 and an optical sensor 103 (see FIG. 2) that has a light emitting element and a photosensitive element.

The actuator 102 integrally has a swinging axis 104 extending in the right and left direction, an abutting lever 105 extending downward from the swinging axis 104, and a light shielding lever 106 extending backward from the swinging axis 104. The swinging axis 104 is rotatably held to, for example, the inner wall (not shown) of the main body casing 2. The abutting lever 105 and light shielding lever 106 intersect at an angle of about 80 degrees, centered around the swinging axis 104.

The actuator 102 is swingably attached so as to be changeable between a detecting state (state shown in FIG. 2), in which the abutting lever 105 extends backward and downward from the swinging axis 104 and the light shielding lever 106 extends backward, and a non-detecting state (state shown in FIG. 10), in which the abutting lever 105 extends forward and downward and the light shielding lever 106 extends backward and slightly downward. The actuator 102 is biased by a spring force of a spring (not shown) so that the actuator 102 is placed in the non-detecting state when external forces other than the spring force are not applied.

The optical sensor 103 has the light emitting element and photosensitive element that are placed opposite to each other in the right and left direction. An optical path of the optical sensor 103, which extends from the light emitting element to the photosensitive element, is blocked by the light shielding lever 106 of the actuator 102, and the actuator 102 placed in the detecting state is positioned at a position to which the light shielding lever 106 is retracted from the optical path. When the light shielding lever 106 is retracted (shifted) from the optical path extending from the light emitting element to the photosensitive element, an ON signal is output from the optical sensor 103. A microcomputer (not shown) is electrically connected to the optical sensor 103.

4. Detection of a New Developing Cartridge

Figure 6:
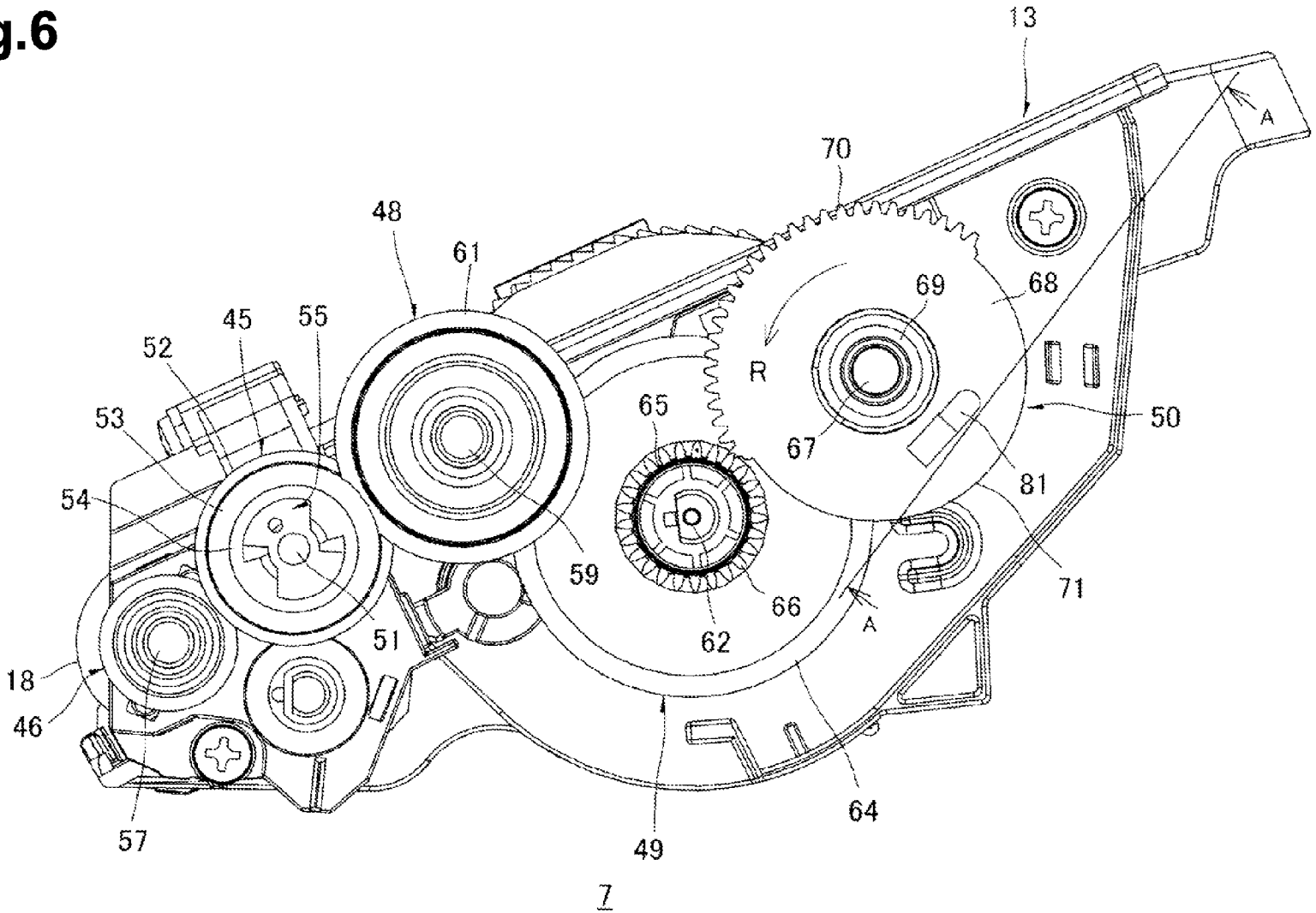
FIG. 6 is a left side view of the developing cartridge with the gear cover removed, indicating a state in which the detection protrusion is positioned at an initial position.
Figure 7:
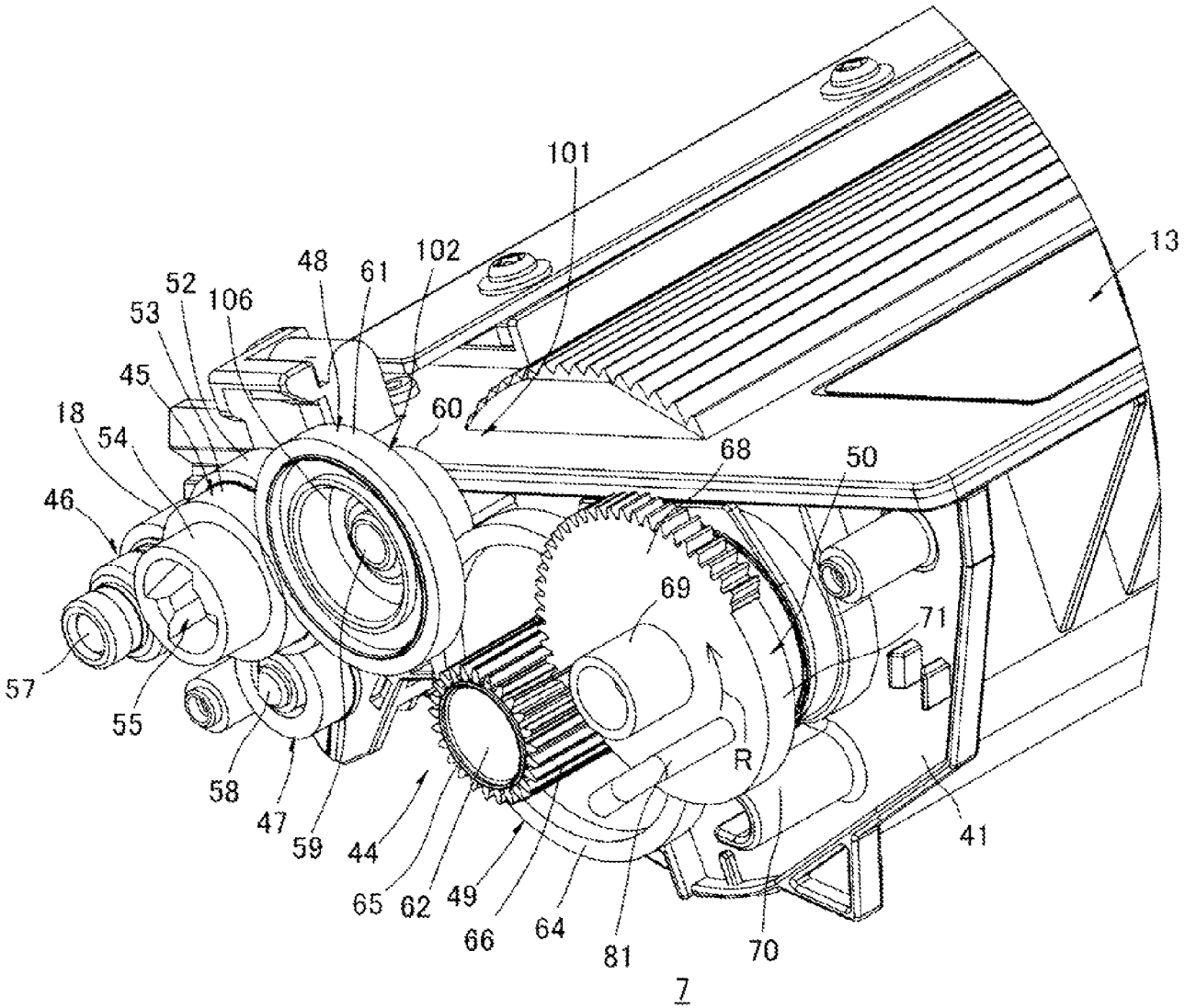
FIG. 7 is a perspective view of the developing cartridge illustrated in FIG. 6, as viewed from the front on the left side.
Figure 8:
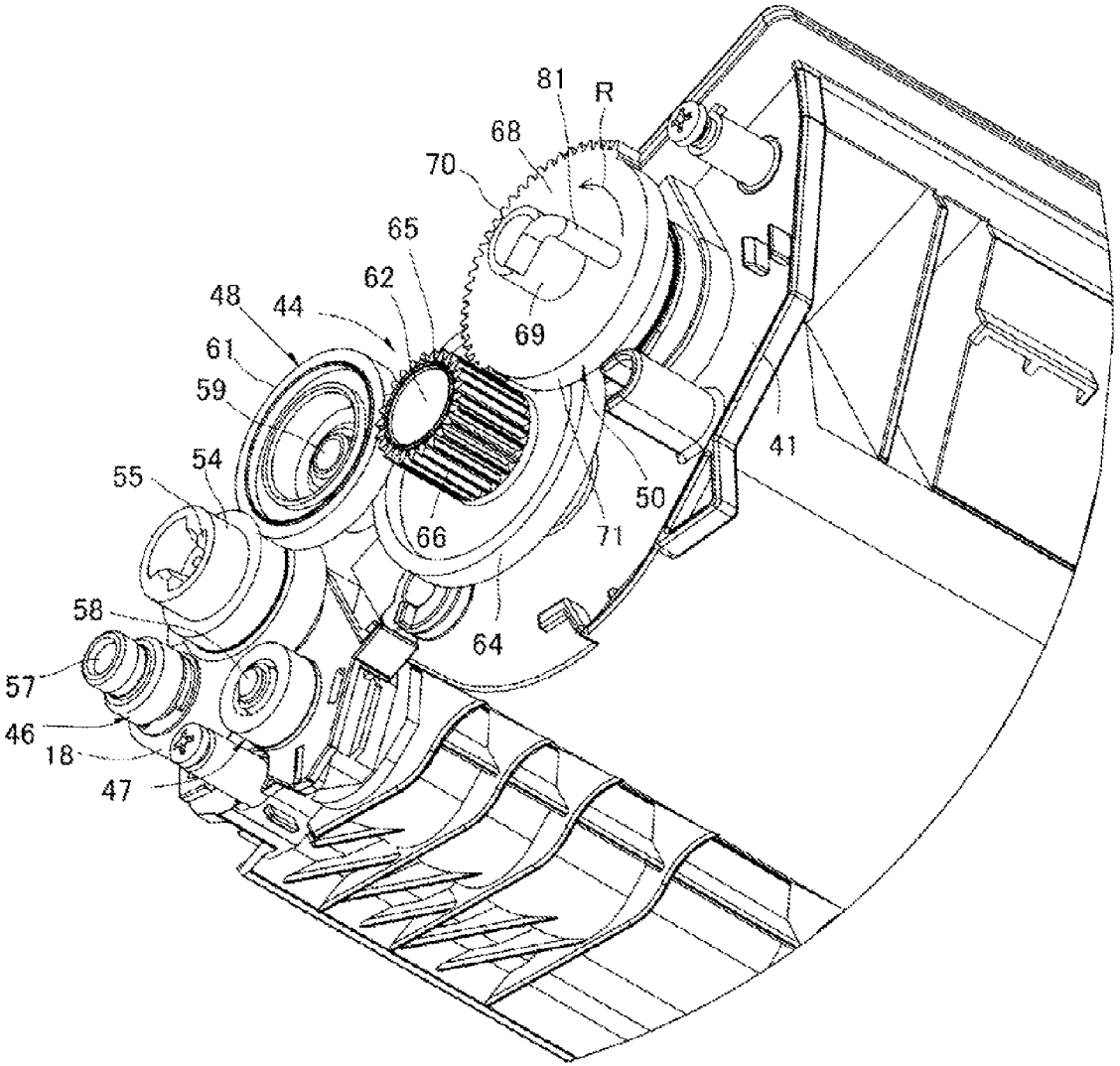
FIG. 8 is a perspective view of the developing cartridge illustrated in FIG. 6, as viewed from the bottom at the front on the left side.
Figure 9:
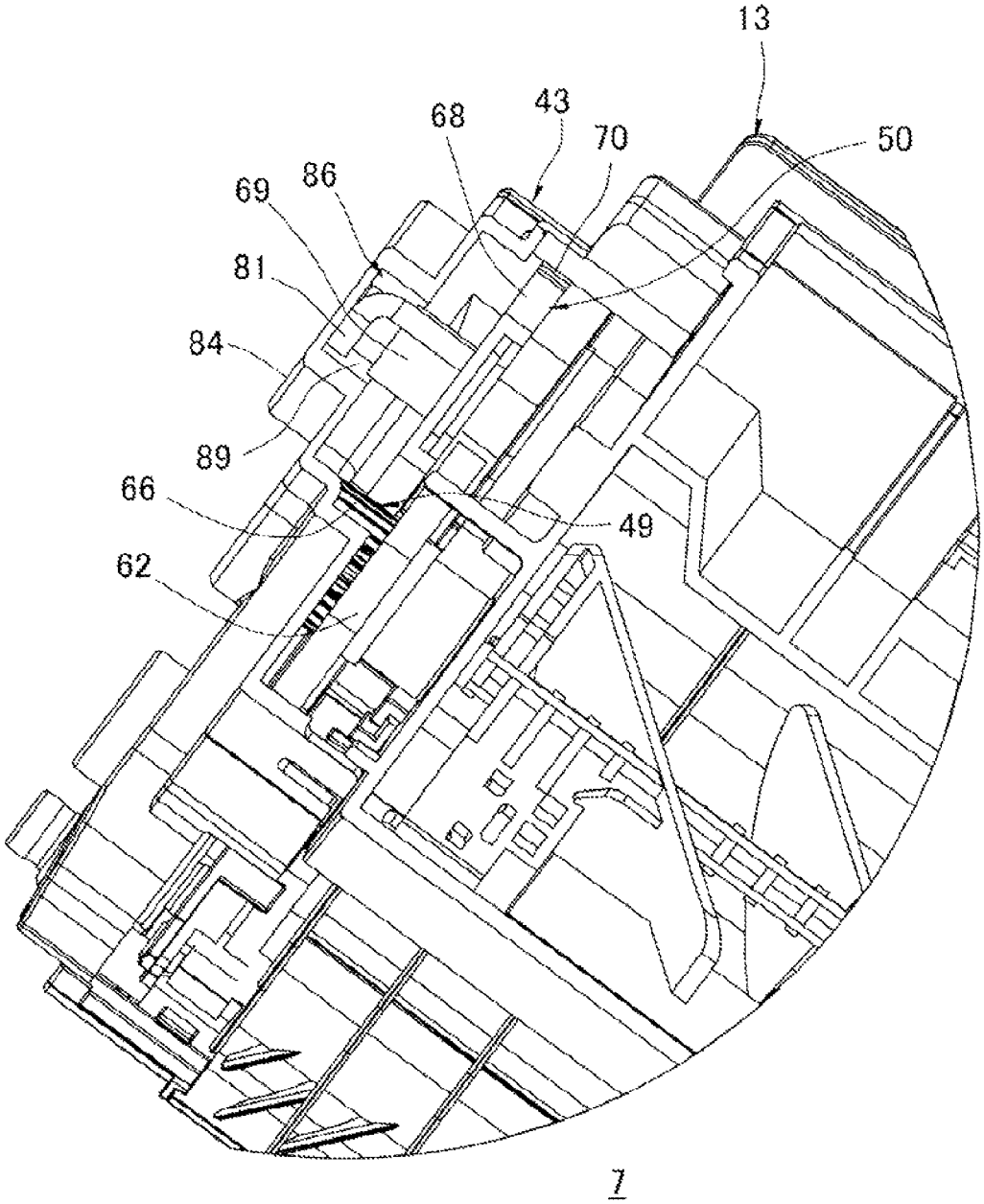
FIG. 9 is a cross sectional view of the developing cartridge (including the gear cover) as taken along cutting-plane line A-A indicated in FIG. 6.

As shown in FIGS. 6, 7, and 8, when the developing cartridge 7 is a new one, the detection protrusion 81 is placed at an initial position below and in front of the rotational axis 67 of the reset gear 50. In this initial state, as shown in FIG. 9, the distal end of the detection protrusion 81 is placed inside the guide part 89 of the gear cover 43, abuts the inner surface of the opposite part 84 at a position upstream of the opening 90 in the rotational direction R (see FIG. 6) of the reset gear 50, and is bent toward the upstream in the rotational direction R. The most downstream gear tooth 70 of the row of the gear teeth 70 of the reset gear 50 in the rotational direction R has been engaged with the gear teeth 66 of the agitator gear 49.

When the developing cartridge 7 is installed in the main body casing 2, a warm-up operation starts for the laser printer 1. In the warm-up operation, the driving output member 56 (see FIG. 3) is inserted into the coupling part 54 (linkage recess 55) of the input gear 45, and the driving force is supplied from the driving output member 56 to the input gear 45, rotating the input gear 45. Due to the rotation of the input gear 45, the developing gear 46, supply gear 47, and intermediate gear 48 are rotated and the developing roller 18 and supply roller 19 are rotated. Due to the rotation of the intermediate gear 48, the agitator gear 49 is rotated and the agitator 16 (see FIG. 1) is rotated. Due to the rotation of the agitator 16, the toner in the developing cartridge 7 is stirred.

When the new developing cartridge 7 is a new one, the gear teeth 66 of the agitator gear 49 and the gear teeth 70 of the reset gear 50 have been mutually engaged; when the agitator gear 49 is rotated, therefore, the reset gear 50 follows the rotation and is rotated in the rotational direction R, which is counterclockwise as viewed from the left side.

Before and immediately after the new developing cartridge 7 is installed in the main body casing 2, the actuator 102 is placed in the non-detecting state, the abutting lever 105 faces the opening 90 of the gear cover 43 in the right and left direction, and the optical path of the optical sensor 103 is blocked by the light shielding lever 106. Thus, an OFF signal is output from the optical sensor 103.

When the reset gear 50 rotates, the distal end of the detection protrusion 81 moves in the guide part 89 in the rotational direction R while sliding on the inner surface of the opposite part 84. When the rotation of the reset gear 50 proceeds and the detection protrusion 81 is released from the upstream end edge of the opening 90 of the gear cover 43 in the rotational direction R, the shape of the detection protrusion 81 is restored by its elasticity, causing the detection protrusion 81 to be placed in a state in which the detection protrusion 81 passes through the opening 90 and to extend in the right and left direction as shown in FIG. 3.

When the rotation of the reset gear 50 proceeds, the distal end of the detection protrusion 81 abuts the abutting lever 105. When the rotation of the reset gear 50 further proceeds, the detection protrusion 81 pushes the abutting lever 105 backward, shifting the actuator 102 from the to non-detecting state to the detecting state as shown in FIG. 2. As a result, the light shielding lever 106 is shifted from the optical path of the optical sensor 103, which extends from the light emitting element to the photosensitive element, and an ON signal is output from the optical sensor 103. Accordingly, detection of the detection protrusion 81 by the optical sensor 103 is achieved.

Figure 10:
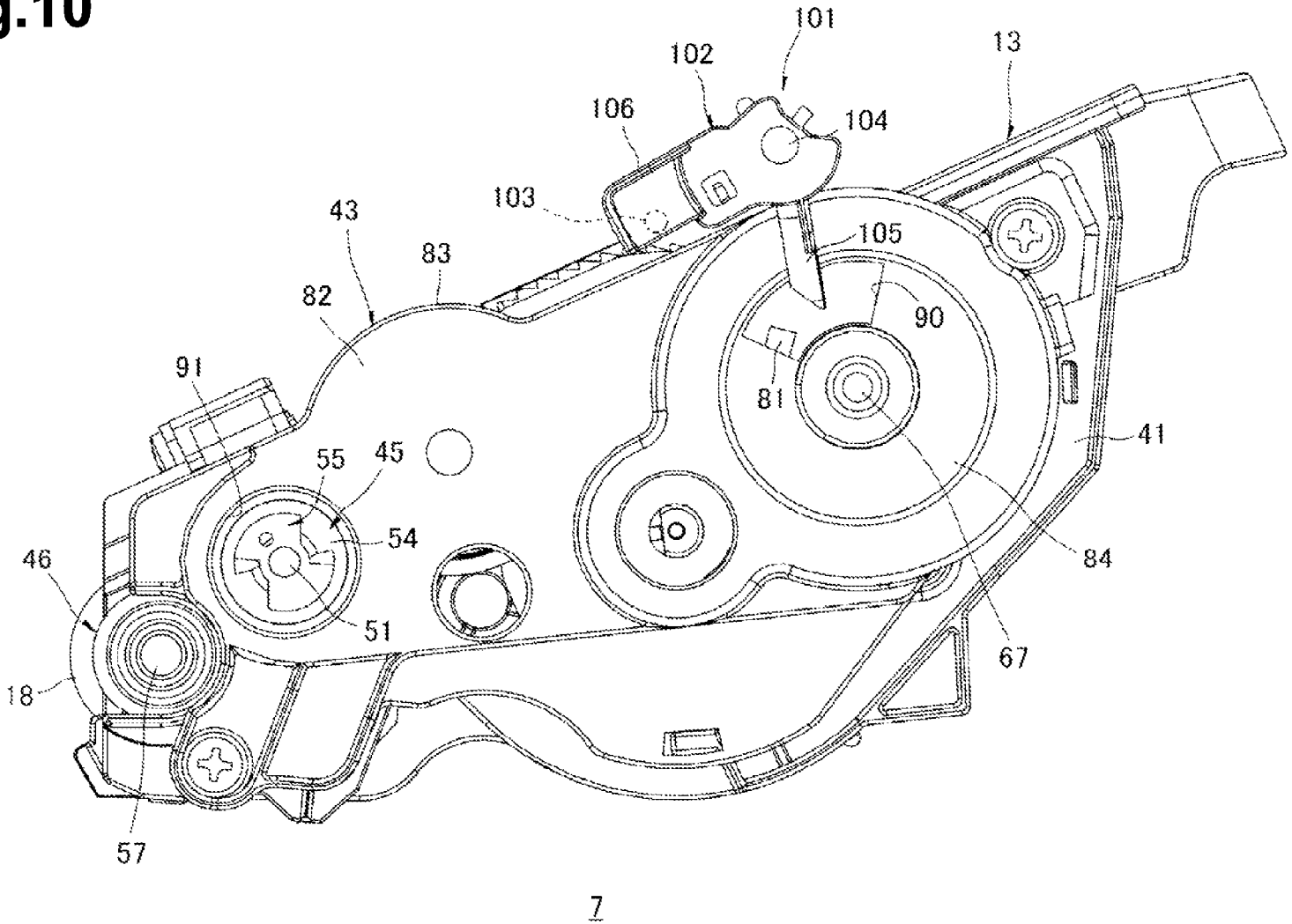
FIG. 10 is a left side view of the developing cartridge, indicating a state in which the detection protrusion is positioned at a terminal position.

When the reset gear 50 further rotates and the detection protrusion 81 is released from the abutting lever 105, the actuator 102 returns from the detecting state to the non-detecting state as shown in FIG. 10. As a result, the optical path of the optical sensor 103, which extends from the light emitting element to the photosensitive element, is blocked by the light shielding lever 106 and the output signal from the optical sensor 103 is switched from the ON signal to an OFF signal.

When the reset gear 50 further rotates, the detection protrusion 81 abuts the downstream end edge of the opening 90 of the gear cover 43 in the rotational direction R. Due to the subsequent rotation of the reset gear 50, the detection protrusion 81 receives a force, which is exerted toward the upstream in the rotational direction R, from the downstream end edge of the opening 90 in the rotational direction R. This force elastically deforms the distal end of the detection protrusion 81 so as to bend the distal end toward the upstream in the rotational direction R and protrude into the inside of the opposite part 84 of the gear cover 43, placing the distal end inside the guide part 89.

Figure 11:
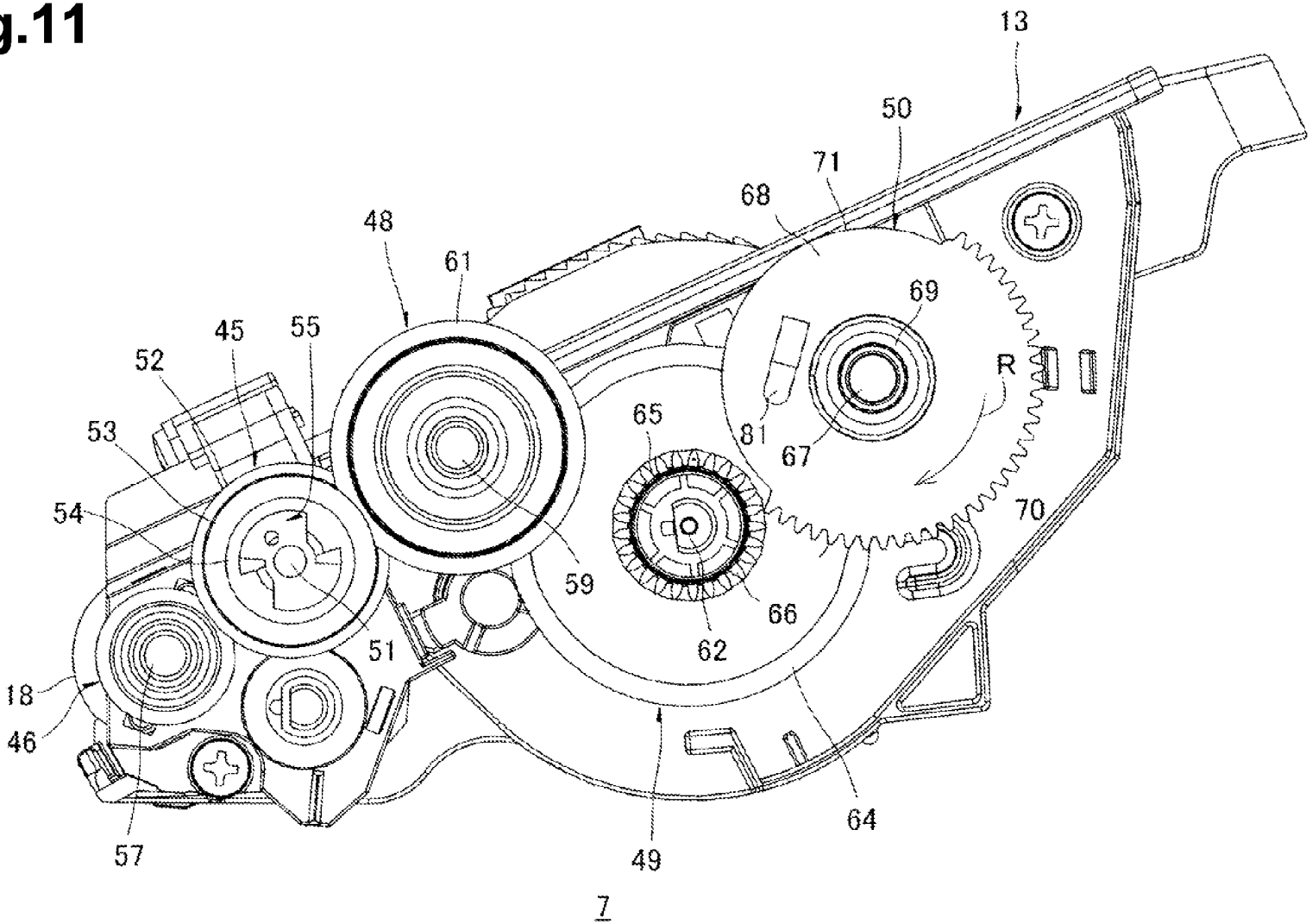
FIG. 11 is a left side view of the developing cartridge with the gear cover removed, indicating a state in which the detection protrusion is positioned at the terminal position.

Then, as shown in FIG. 11, the gear teeth 70 of the reset gear 50 are disengaged from the gear teeth 66 of the agitator gear 49 and the missing tooth part 71 of the reset gear 50 faces the gear teeth 66. Accordingly, the rotation of the reset gear 50 stops and the detection protrusion 81 is placed at a terminal position.

As described above, when the new developing cartridge 7 is installed in the main body casing 2 for the first time, an ON signal is output from the optical sensor 103. Therefore, if an ON signal is output from the optical sensor 103 after the developing cartridge 7 has been installed in the main body casing 2, it can be determined that the developing cartridge 7 is a new one.

When an old developing cartridge 7 (a developing cartridge 7 that has been installed in the main body casing 2 at least once) is installed in the main body casing 2, the rotational position of the reset gear 50 is a position at which the gear teeth 70 have already been disengaged from the gear teeth 66, so even if the warm-up operation of the laser printer 1 is started, the reset gear 50 does not rotate. Therefore, if an ON signal is not output from the optical sensor 103 within a prescribed time after the developing cartridge 7 has been installed in the main body casing 2, it can be determined that the developing cartridge 7 is an old one.

As described above, the input gear 45 is provided in the casing 13 of the developing cartridge 7. The input gear 45 is rotated by a rotation driving force supplied from the outside. When the input gear 45 rotates, the rotation driving force is output from the input gear 45. The developing cartridge 7 has the reset gear 50 that receives the rotation driving force output from the input gear 45 and rotates. The gear cover 43 is attached to the housing 13. The gear cover 43 has the opposite part 84 that faces the reset gear 50 from a side opposite to a side from which the housing 13 faces the reset gear 50.

The reset gear 50 has the detection protrusion 81 at a position apart from its rotational center. The detection protrusion 81, which is formed of an elastic body, protrudes from the reset gear 50 to a side opposite to the housing 13. The detection protrusion 81 abuts the gear cover 43 inside the gear cover 43 and is positioned at the initial position, which is a position before the reset gear 50 rotates, that is, in a state in which the detection protrusion 81 is positioned at the initial position before the reset gear 50 receives the rotation driving force from the input gear 45, in an elastically deformed state.

When, for example, the developing cartridge 7 is installed in the main body casing 2, therefore, the detection protrusion 81 can be made less likely to come into contact with other members (such as the members in the main body casing 2) and the wear and damage of the detection protrusion 81, which is caused by the contact, can thereby be reduced.

Even if the detection protrusion 81 outwardly protrudes from the gear cover 43, since the detection protrusion 81 is formed of an elastic body, almost no wear is generated, which is caused when the detection protrusion 81 is rubbed against a member in the main body casing 2. In addition, even if the detection protrusion 81 abuts another member or is caught by it, since the detection protrusion 81 is elastically deformed, it can be reduced that the detection protrusion 81 and the other member are damaged.

The detection mechanism 101 that detects the detection protrusion 81 is provided in the main body casing 2. The detection protrusion 81 can have been positioned at the initial position, so if the initial position has been appropriately determined, when the reset gear 50 rotates after the developing cartridge 7 has been installed in the main body casing 2, the detection protrusion 81 passes a detection position, at which the detection mechanism 101 detects the detection protrusion 81. Accordingly, superior detection of the detection protrusion 81 by the detection mechanism 101 can be achieved.

When the reset gear 50 rotates, the detection protrusion 81 moves from the initial position to the terminal position. The opposite part 84 of the gear cover 43 has the opening 90, into which the detection protrusion 81 is insertable, on a movement path along which the detection protrusion 81 moves from the initial position to the terminal position.

Accordingly, the detection protrusion 81 protrudes to the outside of the gear cover 43 through the opening 90 while the detection protrusion 81 is moving from the initial state to the terminal position. When the reset gear 50 rotates after the developing cartridge 7 has been installed in the main body casing 2, the detection protrusion 81 protruding to the outside of the gear cover 43 through the opening 90 can be detected by the detection mechanism 101.

The opposite part 84 of the gear cover 43 is circular. The opening 90 has an arc shape along the movement path of the detection protrusion 81. Accordingly, the detection protrusion 81 can be smoothly inserted into the opening 90, and a state in which the detection protrusion 81 is inserted into the opening 90 can be maintained while the detection protrusion 81 moves within the opening 90. This reliably ensures that the detection mechanism 101 detects the detection protrusion 81.

The developing cartridge 7 has the agitator gear 49 used to transmit the rotation driving force, which is output from the input gear 45, to the reset gear 50. The missing tooth gear part 68 to which the rotation driving force is transmitted from the agitator gear 49 is formed on the reset gear 50. The transmission of the rotation driving force from the agitator gear 49 to the missing tooth gear part 68 is discontinued at least when the detection protrusion 81 is positioned at the terminal position. Accordingly, it is possible to stop the detection protrusion 81 at the terminal position and to maintain the state in which the detection protrusion 81 is stopped at the terminal position.

At the terminal position, the detection protrusion 81 is accommodated inside the gear cover 43 in the elastically deformed state. When the developing cartridge 7 is removed from the main body casing 2, therefore, the detection protrusion 81 can be made less likely to come into contact with members in the main body casing 2 and the wear and damage of the detection protrusion 81, which is caused by the contact, can thereby be reduced.

The guide part 89 is formed on the inner surface of the opposite part 84 of the gear cover 43, the guide part 89 guiding the detection protrusion 81 that moves when the reset gear 50 rotates. Accordingly, the detection protrusion 81 can be superiorly moved when the reset gear 50 rotates.

Although an embodiment of the present invention has been described so far, the present invention is not limited to the embodiment described above. In the structure according to the embodiment described above, the reset gear 50 has the missing tooth gear part 68 and the gear teeth 70 are formed on the outer circumferential surface of the missing tooth gear part 68.

Figure 12:
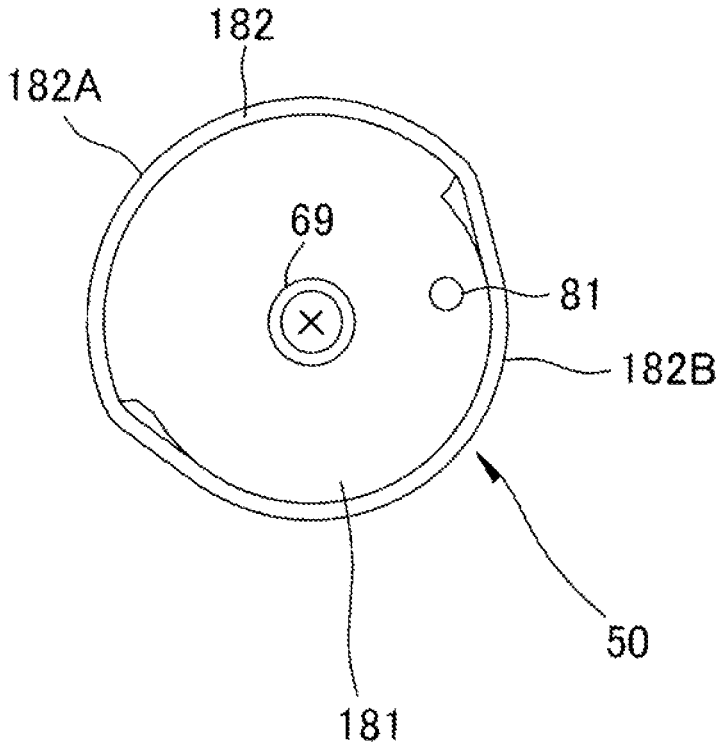
FIG. 12 is a schematic side view illustrating a structure (structure used instead of a missing tooth gear part of a reset gear) according to a variation.

Instead of the missing tooth gear part 68, a main body 181 in a sector plate shape centered around the cylindrical boss 69 and a resistance applying member 182 wound on the outer circumference of the main body 181 may be provided as shown in FIG. 12, at least the outer circumferential surface of the resistance applying member 182 being made of rubber or another material having a relatively large frictional coefficient. In this case, gear teeth may or may not be formed on the circumferential surface of the small-diameter gear part 65 of the agitator gear 49. The main body 181 and resistance applying member 182 are formed so as to have a size that prevents a portion 182B, which is formed on the outer circumferential surface of the resistance applying member 182 and is recessed relatively inside in a radial direction, from coming into contact with the small-diameter gear part 65 and allows an arc surface 182A, which is formed on the outer circumferential surface of the resistance applying member 182 and is placed relatively outside in a radial direction, to come into contact with the circumferential surface of the small-diameter gear part 65.

While certain aspects of the disclosure have been shown and described with reference to certain illustrative embodiments thereof, it will be understood by those skilled in the art that various changes in form and details may be made therein without departing from the spirit and scope of the invention as defined by the appended claims.

The invention claimed is:

1. A cartridge comprising:

a housing;

a driving input member provided at the housing, the driving input member configured to be rotated by an externally supplied rotation driving force;

a rotational member configured to receive the rotation driving force, which is transmitted from the driving input member, and be rotated thereby;

a detection protrusion including an elastic body and which is disposed at a position away from a rotational center of the rotational member, the detection protrusion protruding from the rotational member away from the housing; and a cover attached to the housing, the cover having an opposite part that faces a portion of the rotational member from which the detection protrusion protrudes, wherein, at an initial position, which is a position before the rotational member is rotated, the detection protrusion abuts the opposite part of the cover and wherein the opposite part of the cover is configured to elastically deform the detection protrusion when the detection protrusion is positioned in a state in which the detection protrusion abuts the opposite part of the cover.

2. The cartridge according to claim 1, wherein, when the rotational member rotates, the detection protrusion moves from the initial position to a terminal position and the opposite part of the cover has an opening, into which the detection protrusion is insertable, on a movement path along which the detection protrusion moves from the initial position to the terminal position.

3. The cartridge according to claim 2, wherein the opposite part of the cover is circular, and the opening has an arc shape along the movement path of the detection protrusion.

4. The cartridge according to claim 2, further comprising:

a transmitting member configured to transmit the rotation driving force, which is transmitted from the driving input member, to the rotational member, wherein the rotational member includes a passive part, and wherein the transmission of the rotation driving force from the transmitting member to the passive part is discontinued at least when the detection protrusion is positioned at the terminal position.

5. The cartridge according to any one of claim 2, wherein, at the terminal position, the detection protrusion is accommodated inside the cover in the elastically deformed state.

6. The cartridge according to any one of claim 1, further comprising: a guide part;

wherein the guide part is formed on an inner surface of the opposite part of the cover, and the guide part is configured to guide the detection protrusion when the rotational member rotates.

7. The cartridge according to claim 1, wherein, as the detection protrusion moves from the initial position, wherein the detection protrusion is in an elastically deformed state, to a terminal position, wherein the detection protrusion is in an elastically deformed state, the detection protrusion assumes a second state in which the detection protrusion is not elastically deformed, for at least a part of the time during the movement from the initial position to the terminal position.

8. The cartridge according to claim 1, wherein an inside of the cover is configured to bend the detection protrusion when the detection protrusion abuts the opposite part of the cover.

9. The cartridge according to claim 8, wherein the opposite part of the cover is configured to bend the detection protrusion perpendicularly to a longitudinal axis of the detection protrusion when the detection protrusion abuts the opposite part of the cover.

10. The cartridge according to claim 8, wherein the detection protrusion is bent at least two separate times during the rotation of the rotational member.

11. A cartridge comprising:

a housing;

a driving input member provided at the housing, the driving input member configured to be rotated by an externally supplied rotation driving force;

a rotational member configured to receive the rotation driving force, which is transmitted from the driving input member, and be rotated thereby, wherein the rotational member includes a detection protrusion including an elastic body and which is disposed at a position away from a rotational center of the rotational member; and a cover attached to the housing, the cover having an opposite part that faces the rotational member, wherein, at an initial position, which is a position before the rotational member is rotated, and at a terminal position, which is a position after the rotational member has completed rotating, the detection protrusion abuts the opposite part of the cover and is elastically deformed by the opposite part of the cover, and wherein, at a point between the initial position and the terminal position, the detection protrusion is released from the cover and is positioned in a state in which the detection protrusion is not elastically deformed.

12. The cartridge according to claim 11, further comprising:

a transmission gear configured to transmit the rotation driving force, which is transmitted from the driving input member, to the rotational member, wherein the rotational member includes a first portion of the circumferential surface of the rotational member on which a set of gear teeth are formed, wherein no gear teeth are formed on the remainder of the circumferential surface of the rotational member, and wherein, when the detection protrusion is arrives at the terminal position, the transmission of the rotation driving force from the transmission gear to the rotation member is discontinued by the transmission gear disengaging from the gear teeth of the first portion of the rotational member.

13. The cartridge according to claim 11, wherein the opposite part of the cover is configured to bend the detection protrusion when the detection protrusion abuts the opposite part of the cover.

* * * * *